US010400505B2

(12) United States Patent
Hodak

(10) Patent No.: US 10,400,505 B2
(45) Date of Patent: Sep. 3, 2019

(54) SEALING CLOSURE FOR SWIMMING POOL SKIMMER

(71) Applicant: Michael L. Hodak, Venetia, PA (US)

(72) Inventor: Michael L. Hodak, Venetia, PA (US)

(73) Assignee: Michael L. Hodak, Venetia, PA (US)

( * ) Notice: Subject to any disclaimer, the term of this patent is extended or adjusted under 35 U.S.C. 154(b) by 137 days.

(21) Appl. No.: 15/411,498

(22) Filed: Jan. 20, 2017

(65) Prior Publication Data

US 2017/0298683 A1 Oct. 19, 2017

Related U.S. Application Data

(60) Provisional application No. 62/281,935, filed on Jan. 22, 2016, provisional application No. 62/281,916, filed on Jan. 22, 2016.

(51) Int. Cl.
*E04H 4/12* (2006.01)
*E06B 7/23* (2006.01)
*E06B 3/01* (2006.01)

(52) U.S. Cl.
CPC ..... *E06B 7/231* (2013.01); *E04H 4/1272* (2013.01); *E06B 3/01* (2013.01)

(58) Field of Classification Search
CPC ..... E04H 4/1272; E06B 7/231
USPC ..... 220/241, 242; 264/252, 274
See application file for complete search history.

(56) References Cited

U.S. PATENT DOCUMENTS 4,913,810 A 4/1990 Hodak
5,285,538 A 2/1994 Hodak
5,937,453 A 8/1999 Hodak
6,224,801 B1 * 5/2001 Mango, III ..... B29C 45/14336 264/154
6,966,078 B2 * 11/2005 Evans ..... E04H 4/1272 4/496

* cited by examiner

*Primary Examiner* — Janie M Loeppke
(74) *Attorney, Agent, or Firm* — The Webb Law Firm

(57) ABSTRACT

A sealing closure assembly for closing off a skimmer opening for a swimming pool includes a closure faceplate and a cover removably connectable to the closure faceplate. The closure faceplate has a sidewall surrounding a central opening, a flange protruding from the sidewall to overlap a peripheral area of the skimmer opening, and a lip protruding from the flange and extending around an inner perimeter of the flange. The cover includes a cover plate with a sealing gasket fitted around an outer perimeter of the closure faceplate, a wedge plate member for engaging an inside sidewall of the sealing gasket, and a closure member for exerting a force between the cover plate and the wedge plate to pull the cover plate and wedge plate together between a locked and unlocked position. In the locked position, an outer sidewall of the sealing gasket engages the flange (1) proximate to the sidewall of the closure faceplate, (2) at the lip of the flange, and (3) by wrapping around a terminal edge of the flange.

11 Claims, 7 Drawing Sheets

SEALING CLOSURE FOR SWIMMING POOL SKIMMER

CROSS-REFERENCE TO RELATED APPLICATIONS

This application claims priority to U.S. Provisional Application No. 62/281,916, filed on Jan. 22, 2016 and entitled "Sealing Closure for Swimming Pool Skimmer", and U.S. Provisional Application No. 62/281,935, filed on Jan. 22, 2016 and entitled "Sealing Closure for Swimming Pool Skimmer", the disclosures of which are incorporated herein by reference in their entirety.

BACKGROUND OF THE INVENTION

Field of the Invention

The present invention relates generally to swimming pools and, more particularly, to a sealing apparatus for closing a skimmer opening to prevent water from entering the skimmer when the pool is closed for the season.

Brief Description of the Prior Art

It is common to employ one or more skimming devices in the sidewalls of swimming pools, hot tubs, and the like to permit surface water to be drawn off by a pump, to be filtered at a remote location and then optionally heated, and returned to the pool through one or more return ports. While the present disclosure focuses on skimming devices for swimming pools, it is to be understood that various other water structures, including, without limitation, hot tubs, spas, jet tubs, and the like can have similar or identical skimming devices. These skimming devices have a skimmer opening in a side wall of the pool for drawing the surface water to the pump. During normal use of the pool, the surface level of the water in the pool is at the same level as the skimmer opening such that water from the surface can enter the skimmer opening. When the pool is closed, for example during the winter season, it is sometimes desirable to maintain a lower level of water in the pool for structural purposes. Even if completely drained, the water level in the pool will naturally rise during the closed season due to rainwater and melting snow, such that the water level oftentimes rises to a level of the skimmer opening or above. In such cases, it is necessary to close off the skimmer opening to prevent backflow of water through the skimmer opening and the conduits that connect the skimmer opening to the filter, pump equipment, and heater so as to prevent damage to these components due to freezing.

Within the prior art, one way of closing the skimmer opening is to employ an elongated, plug-like element. The plug element is threadably secured within the floor of the skimmer body to seal the conduit communicating with the pump and filtration equipment. Several other devices for sealing the skimmer opening are disclosed in U.S. Pat. Nos. 4,913,810; 5,285,538; and 5,937,453. Each of these devices has a detachable cover plate or panel that is removably attachable to the skimmer opening. Some of these existing devices either require a retrofit of the skimmer faceplate in order to make sealing contact with a closure member. Other known devices require the use of a polymeric flexible sealing member which snaps over the skimmer opening. Such faceplate seals may lose their effectiveness due to weathering of the polymeric material, and also may require special retrofitting of the skimmer opening member to provide better sealing between the skimmer and the flexible snap-on faceplate. In addition, the existing faceplate seals may crack or be otherwise compromised due to temperature-related shirking and/or contact with ice. Furthermore, due to the conventional square or rectangular shape of the skimmer opening, the existing devices for closing the skimmer opening may not provide an adequate seal in the corners of such skimmer openings. Accordingly, there is a need in the art for an improved sealing closure for the skimmer opening that overcomes the deficiencies of the prior art.

SUMMARY OF THE INVENTION

In view of the existing need in the art, it would be desirable to develop a sealing closure assembly for a swimming pool skimmer opening that overcomes the deficiencies associated with the existing devices.

In accordance with some preferred and non-limiting embodiments or aspects of the present disclosure, a sealing closure assembly for closing a skimmer opening of a swimming pool may have a closure faceplate having a sidewall with a central opening shaped to correspond to the skimmer opening. The closure faceplate may have a flange protruding from the sidewall to overlap a peripheral area of the skimmer opening, and a lip protruding from the flange and extending around an inner perimeter of the flange. The sealing closure assembly may further have a cover removably connectable to the closure faceplate to seal the central opening of the closure faceplate. The cover may have a cover plate with a monolithic sealing gasket fitted around an outer perimeter of the closure faceplate, a wedge plate member for engaging an inside sidewall of the sealing gasket, and a closure member for exerting a force between the cover plate and the wedge plate to pull the cover plate and wedge plate together between a locked position and an unlocked position. In the locked position, an outer sidewall of the sealing gasket may engage the flange (1) proximate to the sidewall of the closure faceplate, (2) at the lip of the flange, and (3) by wrapping around a terminal edge of the flange.

In accordance with other preferred and non-limiting embodiments or aspects of the present disclosure, movement of the wedge plate member against the sealing gasket may cause the outer sidewall of the sealing gasket to flex outwardly and engage the flange of the closure faceplate to prevent water leakage into the skimmer opening. The closure member may have a stud member for attachment to the cover plate. The stud member extending rearwardly from the cover plate and having a hook portion at a distal end. The closure member may also have the wedge plate member having a bore hole formed therethrough to allow passage of the hook portion of the stud, and a cam lock fitted on a rear surface of the wedge plate member for attachment to the hook portion of the stud. Movement of the cam lock may force the wedge plate member into engagement with the sealing gasket.

In accordance with other preferred and non-limiting embodiments or aspects of the present disclosure, the closure faceplate, cover plate, wedge plate, and cam lock may be made of an injection molded plastic material. The sealing gasket may be made of a thermoplastic elastomer material. The flange may have one or more locking elements on the flange for connecting to a peripheral flange on the skimmer opening. Each of the one or more locking elements may be formed on an outer periphery of the flange. The closure faceplate may have one or more radiused corners defining the central opening. A radius of the one or more radiused corners may be between 0.25 inches and 1 inches.

In accordance with other preferred and non-limiting embodiments or aspects of the present disclosure, a sealing closure assembly for closing a skimmer opening of a swimming pool skimmer may have a closure faceplate having an integral sidewall with a central opening in a shape of the skimmer opening. The closure assembly may further have a cover element configured for being removably connected to the closure faceplate. The cover element may have a cover plate having a top surface opposite a bottom surface and a plurality of openings extending between the top surface and the bottom surface around an outer periphery of the cover plate. A sealing gasket may extend around the outer periphery of the cover plate. At least a portion of the sealing gasket may extend through at least one of the plurality of openings on the cover plate.

In accordance with other preferred and non-limiting embodiments or aspects of the present disclosure, the sealing gasket may have a peripheral recess for receiving the peripheral lip of the closure faceplate when the cover element is connected to the closure faceplate. The closure faceplate may have a peripheral lip extending around an outer periphery of the closure faceplate, and a flange that overlaps a peripheral area of the skimmer opening. The closure faceplate may be made from an ABS plastic resin, while the sealing gasket may be made from a thermoplastic elastomer material. The sealing gasket may be molded over the cover plate such that the sealing gasket is monolithically formed with the cover plate.

In accordance with other preferred and non-limiting embodiments or aspects of the present disclosure, a cover element for closing a skimmer opening of a swimming pool skimmer may have a cover plate having a top surface opposite a bottom surface and a plurality of openings extending between the top surface and the bottom surface around an outer periphery of the cover plate. The sealing assembly may further have a sealing gasket monolithically formed around the outer periphery of the cover plate. At least a portion of the sealing gasket may extend through at least one of the plurality of openings on the cover plate. The sealing gasket may have a peripheral recess for receiving a peripheral lip of a closure faceplate when the cover element is connected to the closure faceplate. The sealing gasket may be monolithically formed with the cover plate.

In accordance with other preferred and non-limiting embodiments or aspects of the present disclosure, the sealing closure assembly may be defined by one or more of the following clauses:

Clause 1: A sealing closure assembly for closing a skimmer opening of a swimming pool, the sealing closure assembly comprising:

a closure faceplate having a sidewall with a central opening shaped to correspond to the skimmer opening, the closure faceplate comprising:

a flange protruding from the sidewall to overlap a peripheral area of the skimmer opening; and a lip protruding from the flange and extending around an inner perimeter of the flange; and a cover removably connectable to the closure faceplate to seal the central opening of the closure faceplate, the cover comprising:

a cover plate with a monolithic sealing gasket fitted around an outer perimeter of the closure faceplate;

a wedge plate member for engaging an inside sidewall of the sealing gasket; and a closure member for exerting a force between the cover plate and the wedge plate to pull the cover plate and wedge plate together between a locked position and an unlocked position, wherein, in the locked position, an outer sidewall of the sealing gasket engages the flange (1) proximate to the sidewall of the closure faceplate, (2) at the lip of the flange, and (3) by wrapping around a terminal edge of the flange.

Clause 2: The sealing closure assembly of clause 1, wherein movement of the wedge plate member against the sealing gasket causes the outer sidewall of the sealing gasket to flex outwardly and engage the flange of the closure faceplate to prevent water leakage into the skimmer opening.

Clause 3: The sealing closure assembly of clause 1 or clause 2, wherein the closure member comprises:

a stud member for attachment to the cover plate, the stud member extending rearwardly from the cover plate and having a hook portion at a distal end;

the wedge plate member having a bore hole formed therethrough to allow passage of the hook portion of the stud, and a cam lock fitted on a rear surface of the wedge plate member for attachment to the hook portion of the stud, whereby movement of the cam lock forces the wedge plate member into engagement with the sealing gasket.

Clause 4: The sealing closure assembly of clause 3, wherein the closure faceplate, cover plate, wedge plate, and cam lock are made of an injection molded plastic material.

Clause 5: The sealing closure assembly of any of clauses 1-4, wherein the sealing gasket is made of a thermoplastic elastomer material.

Clause 6: The sealing closure assembly of any of clauses 1-5, further comprising one or more locking elements on the flange for connecting to a peripheral flange on the skimmer opening.

Clause 7: The sealing closure assembly of clause 6, wherein each of the one or more locking elements is formed on an outer periphery of the flange.

Clause 8: The sealing closure assembly of any of clauses 1-7, wherein the closure faceplate has one or more radiused corners defining the central opening.

Clause 9: The sealing closure assembly of clause 8, wherein a radius of the one or more radiused corners is between 0.25 inches and 1 inches.

Clause 10: A sealing closure assembly for closing a skimmer opening of a swimming pool skimmer, the sealing closure assembly comprising:

a closure faceplate having an integral sidewall with a central opening in a shape of the skimmer opening;

a cover element configured for being removably connected to the closure faceplate, the cover element comprising:

a cover plate having a top surface opposite a bottom surface and a plurality of openings extending between the top surface and the bottom surface around an outer periphery of the cover plate; and a sealing gasket extending around the outer periphery of the cover plate, wherein at least a portion of the sealing gasket extends through at least one of the plurality of openings on the cover plate.

Clause 11: The sealing closure assembly of clause 10, wherein the sealing gasket has a peripheral recess for receiving the peripheral lip of the closure faceplate when the cover element is connected to the closure faceplate.

Clause 12: The sealing closure assembly of clause 10 or clause 11, wherein the closure faceplate has a peripheral lip extending around an outer periphery of the closure faceplate Clause 13: The sealing closure assembly of any of clauses 10-12, wherein the closure faceplate has a flange that overlaps a peripheral area of the skimmer opening.

Clause 14: The sealing closure assembly of any of clauses 10-13, wherein the closure faceplate is made from an ABS plastic resin.

Clause 15: The sealing closure assembly of any of clauses 10-14, wherein the sealing gasket is made from a thermoplastic elastomer material.

Clause 16: The sealing closure assembly of any of clauses 10-15, wherein the sealing gasket is molded over the cover plate.

Clause 17: The sealing closure assembly of any of clauses 10-16, wherein the sealing gasket is monolithically formed with the cover plate.

Clause 18: A cover element for closing a skimmer opening of a swimming pool skimmer, the cover element comprising:

a cover plate having a top surface opposite a bottom surface and a plurality of openings extending between the top surface and the bottom surface around an outer periphery of the cover plate; and a sealing gasket monolithically formed around the outer periphery of the cover plate, wherein at least a portion of the sealing gasket extends through at least one of the plurality of openings on the cover plate.

Clause 19: The cover element of clause 18, wherein the sealing gasket has a peripheral recess for receiving a peripheral lip of a closure faceplate when the cover element is connected to the closure faceplate.

Clause 20: The cover element of clause 18 or clause 19, wherein the sealing gasket is monolithically formed with the cover plate.

These and other features and characteristics of the sealing closure assemblies described herein will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only.

BRIEF DESCRIPTION OF THE DRAWINGS

In FIGS. 1-14, the same characters represent the same components unless otherwise indicated.

DETAILED DESCRIPTION OF INVENTION

Figure 1:
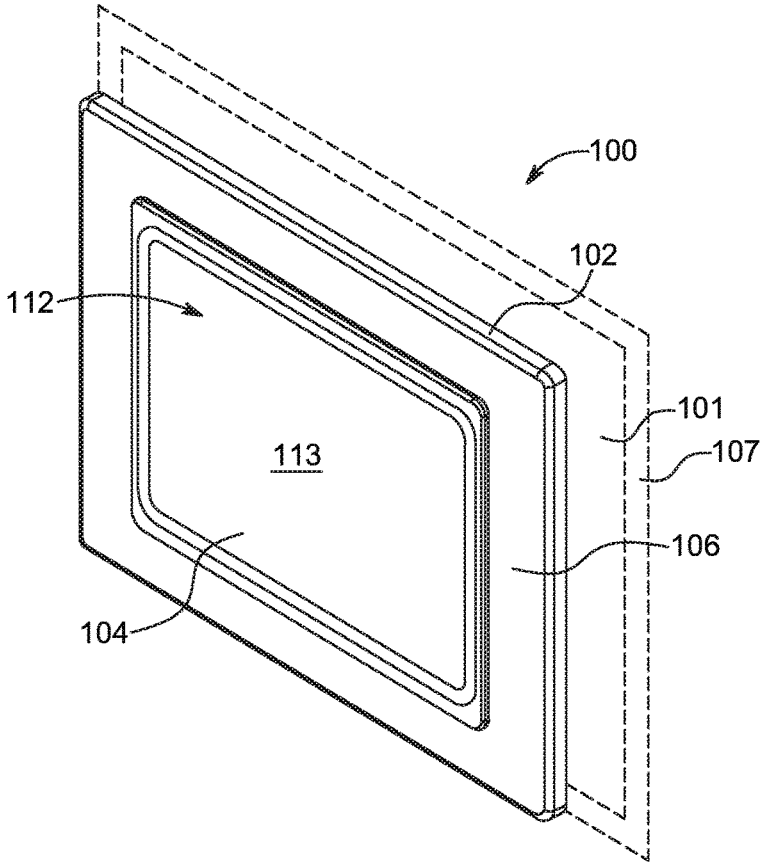
FIG. 1 is an assembled perspective view of a sealing closure assembly of one preferred and non-limiting embodiment or aspect of the present disclosure.

As used herein, the singular form of "a", "an", and "the" includes plural referents unless the context clearly dictates otherwise.

As used herein, spatial or directional terms, such as "left", "right", "up", "down", "inner", "outer", "above", "below", and the like, relate to various features as depicted in the drawing figures. However, it is to be understood that various alternative orientations can be assumed and, accordingly, such terms are not to be considered as limiting.

Unless otherwise indicated, all ranges or ratios disclosed herein are to be understood to encompass any and all subranges or subratios subsumed therein. For example, a stated range or ratio of "1 to 10" should be considered to include any and all subranges between (and inclusive of) the minimum value of 1 and the maximum value of 10; that is, all subranges or subratios beginning with a minimum value of 1 or more and ending with a maximum value of 10 or less, such as but not limited to, 1 to 6.1, 3.5 to 7.8, and 5.5 to 10.

As used herein, the term "substantially parallel" means a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

All documents, such as but not limited to issued patents and patent applications, referred to herein, and unless otherwise indicated, are to be considered to be "incorporated by reference" in their entirety.

With reference to FIG. 1, a sealing closure assembly 100 is configured for use with a skimmer (not shown) of a pool, spa, hot tub, or the like. The sealing closure assembly 100 is configured to close a skimmer opening 101 and prevent water from entering the skimmer opening 101. Typically, the skimmer is mounted on a pool sidewall. The skimmer has a peripheral flange 107 that defines the skimmer opening 101. The peripheral flange 107 may be secured to the pool sidewall by fasteners (not shown) or other mechanical means. Surface water from the pool is drawn through the skimmer opening 101 for subsequent pumping, filtration, and heating purposes. The details of one exemplary embodiment or aspect of a skimmer and its function are described in U.S. Pat. No. 5,285,538, the contents of which are incorporated by reference herein. At least a portion of the sealing closure assembly 100 is configured to be inserted in the skimmer opening 101 to block the skimmer opening 101 and prevent the passage of water therethrough.

With continued reference to FIG. 1, the sealing closure assembly 100 includes a closure faceplate 102 and a cover 104 configured for removably connecting to the closure faceplate 102. The closure faceplate 102 is configured to be connected to the skimmer opening 101 on the pool or water side of the skimmer. The closure faceplate 102 has a generally square or rectangular shape, at least a portion of which is dimensioned to fit inside the skimmer opening 101. Desirably, an outer shape of at least a portion of the closure faceplate 102 is shaped to correspond to the shape of the skimmer opening 101. In some aspects, the closure faceplate 102 may be installed directly on the sidewall of the pool. In other aspects, the closure faceplate 102 may be installed over the skimmer peripheral flange 107.

With reference to FIGS. 2-5, the closure faceplate 102 has a sidewall 106 defining an outer peripheral shape of the closure faceplate 102. The sidewall 106 has a central opening 108 with a flange 103 that extends around an inner periphery of the central opening 108 and protrudes rearwardly relative to the sidewall 106. In some aspects, at least a portion of the flange 103 may be inserted into the skimmer opening 101 such that the sidewall 106 overlaps at least a portion of the skimmer opening 101 in order to prevent movement of the closure faceplate 102 into the skimmer opening 101. In other aspects, at least a portion of the flange 103 may interact with the skimmer peripheral flange 107 (shown in FIG. 1) such that the sidewall 106 overlaps at least a portion of the skimmer opening 101 and/or the skimmer peripheral flange 107. In further examples, the flange 103 may narrow or widen in a direction from away from an outer surface of the sidewall 106 toward the skimmer opening 101. In other examples, the flange 103 may be substantially perpendicular to the sidewall 106.

Figure 8:
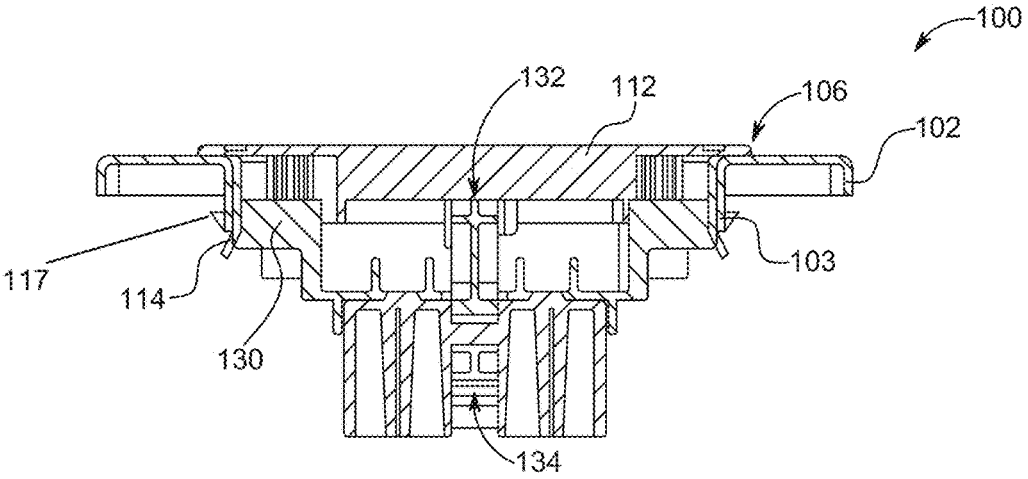
FIG. 8 is a cross-sectional side view of the sealing closure assembly shown in FIG. 7.

The closure faceplate 102 may be removably or non-removably connected to the skimmer opening 101 and/or the skimmer peripheral flange 107. With specific reference to FIGS. 4-5, the flange 103 of the closure faceplate 102 has one or more locking elements 110 configured to connect with the skimmer peripheral flange (not shown) installed around the skimmer opening 101. The one or more locking elements 110 may be formed at an outer periphery of the flange 103. In some aspects, the one or more locking elements 110 may formed as tabs that snap over the skimmer peripheral flange installed around the skimmer opening 101. At least a portion of the flange 103 may be flexible to allow the one or more locking elements 110 to be deflected such that they can pass over the skimmer peripheral flange. Alternatively, the flange 103 may be rigid, while the one or more locking elements 110 may flex or deflect relative to the flange 103 to allow the closure faceplate 102 to be connected to the skimmer peripheral flange installed around the skimmer opening 101. In further aspects, the flange 103 and the one or more locking elements 110 may be rigid, while at least a portion of the skimmer peripheral flange may be deflectable or be configured to interact with the locking elements 110 in order to connect the closure faceplate 102 to the skimmer peripheral flange. In some aspects, the flange 103 and/or the one or more locking elements 110 may be movable between a first, undeflected position and a second, deflected position. Once the one or more locking elements 110 clear the skimmer peripheral flange, the one or more locking elements 110 may snap back to the initial, undeflected position. In further aspects, such as shown in FIG. 8, the one or more locking elements 110 may have a ramp surface 117 that engages the skimmer peripheral flange to aid in deflecting the one or more locking elements 110 and/or at least a portion of the skimmer peripheral flange during installation of the closure faceplate 102 on the skimmer peripheral flange.

One of ordinary skill in the art will appreciate that the one or more locking elements 110 may be formed as tabs, snaps, or other fastening elements that connect the closure faceplate 102 to the skimmer peripheral flange 107. In other aspects, the sidewall 106 of the closure faceplate 102 may have one or more through-holes (not shown) configured to receive a fastener element (not shown), such as a screw, to connect the closure faceplate 102 to the skimmer opening 101 and/or the skimmer peripheral flange 107. In further aspects, the closure faceplate 102 may be connected to the skimmer opening 101 and/or the skimmer peripheral flange 107 by an adhesive. The underside of the closure faceplate 102 could have several undercut notched areas (not shown) formed therein to permit the insertion of a removal tool, such as a screwdriver tip, to permit removal of the closure faceplate 102 from the skimmer opening 101 and the skimmer peripheral flange 107, if desired.

In some aspects, the closure faceplate 102 is formed as a one-piece integral member formed from a rigid material. For example, the closure faceplate 102 may be injection molded from a hard plastic material, such as an ABS plastic resin that resists dimensional shrinking due to temperature variations. In other aspects, the closure faceplate 102 may be formed from metal, composite material, such as carbon fiber, or a combination of metal, plastic, and/or composite materials. In various aspects, the closure faceplate 102 is made from a rigid material capable of resisting stretching or breaking due to contact with ice which may form in the pool.

Figure 2:
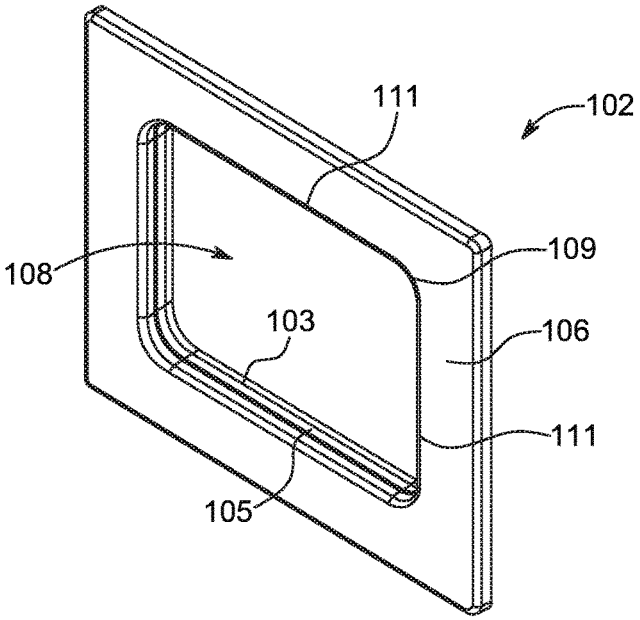
FIG. 2 is a perspective view of a closure faceplate of the sealing closure assembly shown in FIG. 1.
Figure 3:
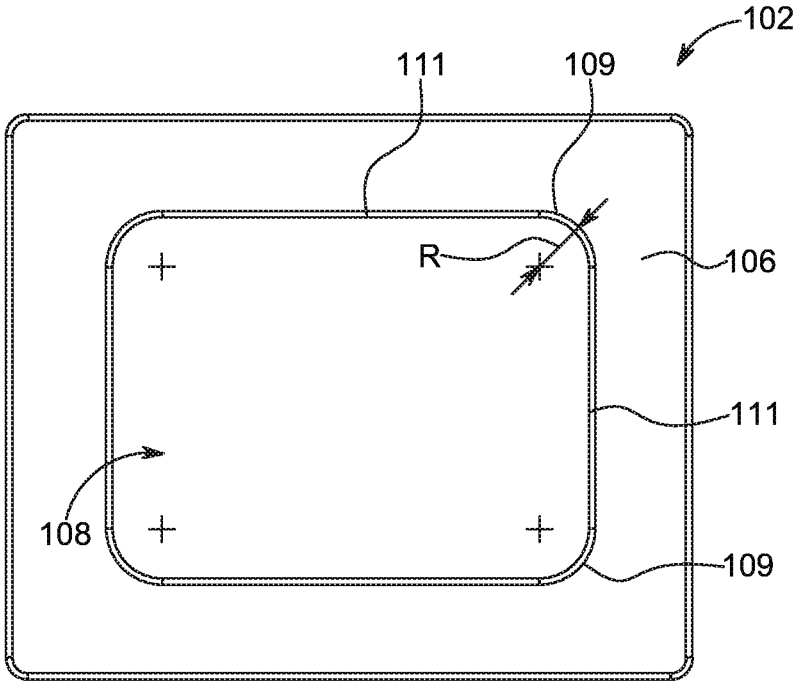
FIG. 3 is a front view of the closure faceplate shown in FIG. 2.
Figure 4:
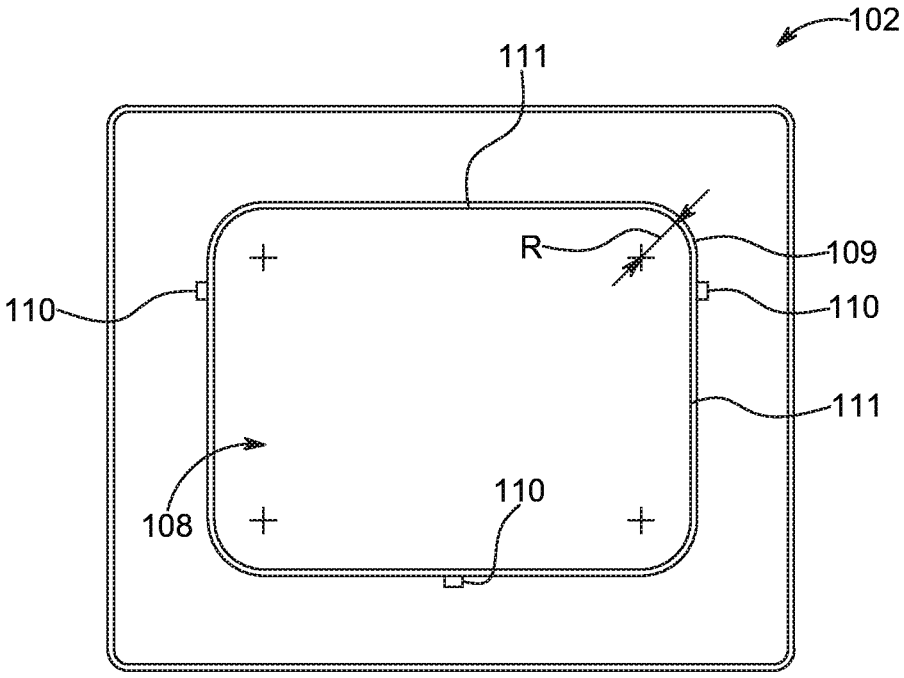
FIG. 4 is a rear view of the closure faceplate shown in FIG. 2.
Figure 5:
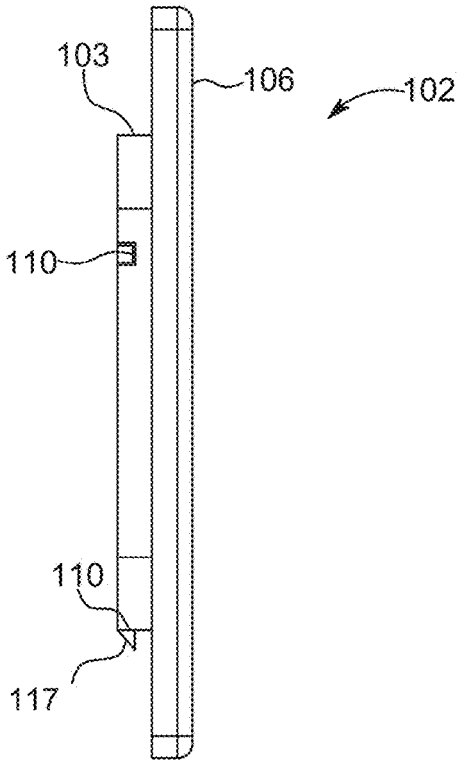
FIG. 5 is a side view of the closure faceplate shown in FIG. 2.

With reference to FIGS. 2-4, the closure faceplate 102 may have one or more radiused corners 109 at apex locations of the central opening 108. In some aspects, the radiused corners 109 may be provided to ease the transition between the adjoining linear or substantially linear portions 111 of the closure faceplate 102 to provide a better sealing interface with the sealing gasket of the cover 104, as described herein. For example, the radiused corners 109 may have a radius R between 0.25" to 1" and may join to linear or substantially linear portions that are oriented at a substantially perpendicular angle. In this manner, the radiused corners 109 provide a smooth transition between the adjoining linear or substantially portions 111 in the corners of the central opening 108 to prevent leakage of water. The sealing gasket of the cover 104 may be dimensioned such that the sealing gasket has a shape that corresponds to the shape of the central opening 108. That is, the sealing gasket of the cover 104 may have one or more linear or substantially linear portions that correspond to the one or more linear or substantially linear portions 111 of the closure faceplate 102 and one or more radiused portions with a radius that substantially corresponds to the radius R of the radiused corners 109 of the closure faceplate 102.

With specific reference to FIG. 2, the closure faceplate 102 may have a lip 105 extending around at least a portion of a periphery of the central opening 108. The lip 105 may protrude inward into the central opening 108 and may be configured for interacting with at least a portion of the cover 104, such as a sealing gasket of the cover 104, as described herein.

A sealant or a gasket (not shown) may be provided around at least a portion of the outer periphery of the flange 103 and/or the rear portion of the sidewall 106 to seal against water intrusion between the closure faceplate 102 and the skimmer peripheral flange 107 (shown in FIG. 1). For example, a bead of silicone sealing compound or other sealant material may be provided between the closure faceplate 102 and the skimmer peripheral flange 107. Alternatively, a resilient gasket may be provided on at least one of the closure faceplate 102 and the skimmer peripheral flange 107 for sealing a connection interface between the two once they are connected together.

Figure 6:
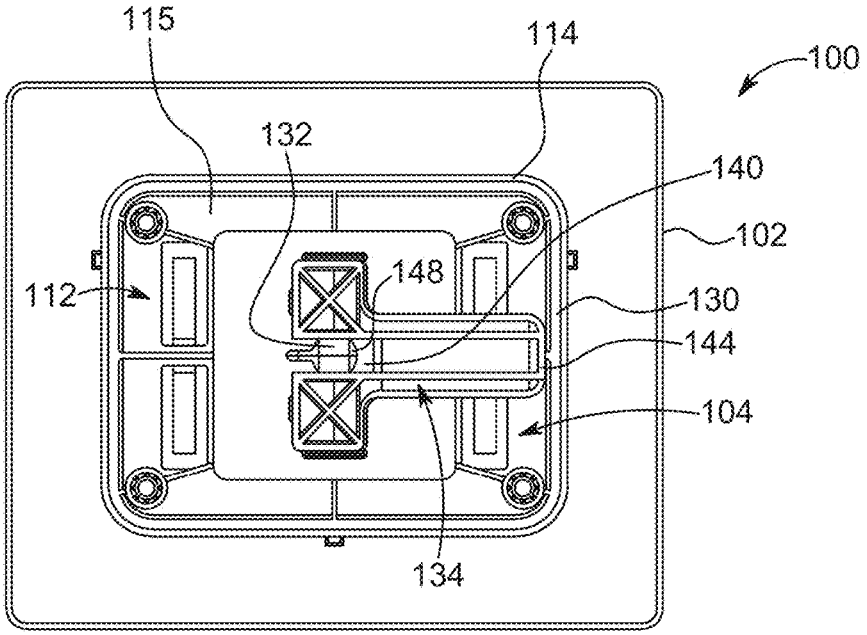
FIG. 6 is a rear view of the sealing closure assembly shown in FIG. 1.
Figure 7:
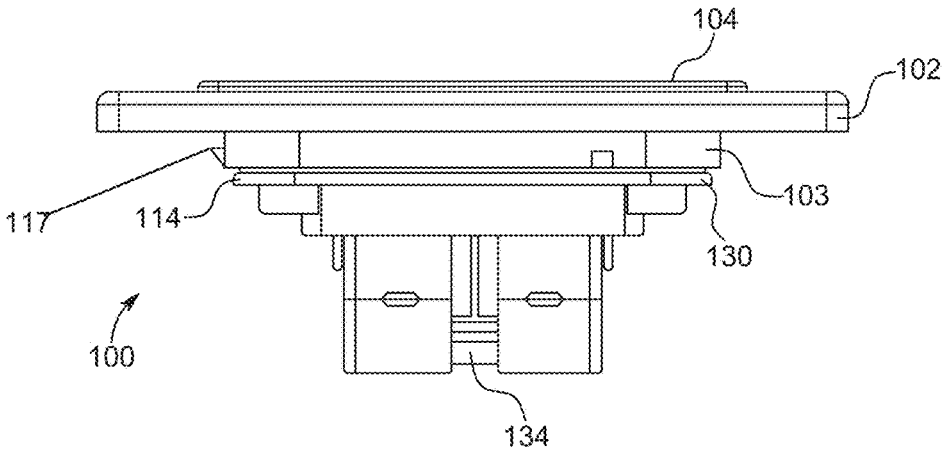
FIG. 7 is a side view of the sealing closure assembly shown in FIG. 1.

With reference to FIGS. 1 and 6-8, the cover 104 is configured to be removably secured to the closure faceplate 102 to enclose the central opening 108 and prevent passage of water through the central opening 108 and into the skimmer opening 101. The cover 104 has a cover plate 112 that is shaped to correspond to the central opening 108 of the closure faceplate 102. The cover plate 112 has a top surface 113 (FIG. 1) opposite a bottom surface 115 (FIG. 6). A sealing gasket 114 extends around an outer periphery of the cover plate 112. The cover plate 112, together with the sealing gasket 114, fits snugly within the central opening 108 bordered by the flange 103 of the closure faceplate 102. For example, the cover plate 112 may be configured to interface with the closure faceplate 102, such as the flange 103, such that the sealing gasket 114 contacts at least a portion of the flange 103 for a watertight seal between the cover plate 112 and the closure faceplate 102.

The sealing gasket 114 may be a monolithic component, or it may be comprised of two or more separate elements. In some aspects, the sealing gasket 114 is formed separately from the cover plate 112 and is removably or non-removably installed on the cover plate 112. In other aspects, the sealing gasket 114 is formed together with the cover plate 112, such as by co-molding. In some aspects, the sealing gasket 114 may be formed from a resilient material, such as a thermoplastic elastomer, which remains flexible in varying temperature settings and is resistant to degradation over time. The sealing gasket 114 may be formed, for example, by injection molding, or, as noted above, by co-molding with the cover plate 112.

The sealing gasket 114 is adapted to sealingly engage the flange 103 of the closure faceplate 102 when a wedge-shaped spreader plate 130 is forced into engagement with the cover plate 112 and exerts a rearward force thereon by way of a hook stud 132 attached to the cover plate 112 and acted upon by a cam lock 134 which exerts the desired rearward force. The hook stud 132 carries a hook portion 148 which extends through a bore formed through the spreader or wedge-shaped spreader plate 130 whereupon the hook portion 148 can engage a bar 140 carried by the cam lock 134. The cam lock 134 carries the curved cam surfaces and an outwardly extending arm 144. When the bar 140 of the cam lock 134 engages the hook portion 138 of the hook stud 132, the curved cam surfaces press against a rear face of the spreader plate 130 and exert a closing force thereon when the arm is moved. The cover plate 112, wedge-shaped spreader or spreader plate 130, and cam lock 134 are all preferably made from injection molded plastic materials, such as an ABS plastic material, or the like. Additional details of the cover plate 112 are discussed in U.S. Pat. No. 9,133,638, the disclosure of which is incorporated herein in its entirety.

In some aspects, the seal created between the sealing gasket 114 and the flange 103 of the closure faceplate 102 may have three separate sealing interfaces that together define the seal. The first sealing interface may be the wedging of the sealing gasket 114 at the flange 103 on the pool side of the sidewall 106 of the closure faceplate 102. This first sealing interface is created due to the wedging action of the wedge plate 130. A second sealing interface may be formed between the sealing gasket 114 and the lip 105 of the closure faceplate 102. In some aspects, the sealing gasket 114 may have one or more depressions (not shown) that correspond to the shape of the lip 105 such that at least a portion of the lip 105 may be positioned within the sealing gasket 114. A third sealing interface may be formed between a rear edge of the flange 103 and the sealing gasket 114. In some aspects, the sealing gasket 114 may be longer than a width of the flange 103 such that at least a portion of the sealing gasket 114 may wrap around the edge of the flange 103 when the wedge-shaped spreader plate 130 is in the locked position.

Having described the structure of the sealing closure assembly 100, a method of installing the sealing closure assembly 100 to close the skimmer opening 101 and prevent the passage of water into the skimmer opening 101 will now be described. To install the sealing closure assembly 100, the closure faceplate 102 is first installed on the skimmer opening 101, for example by snapping the closure faceplate 102 such that the one or more locking elements 110 lockingly engage the closure faceplate 102 with the skimmer peripheral flange 107. In various other aspects, the closure faceplate 102 may be installed on the skimmer peripheral flange 107 by one or more fasteners, adhesive, or any other mechanical connection means that securely retains the closure faceplate 102 on the skimmer peripheral flange 107. When installed, the closure faceplate 102 surrounds the skimmer opening 101 such that obstructing the central opening 108 of the closure faceplate 102 also obstructs the skimmer opening 101. Next, the cover 104, including the cover plate 112, spreader-shaped spreader or wedge plate 130, and the cam lock 134 mated together, is inserted into the central opening 108 of the closure faceplate 102. The assembled closure element is inserted into the central opening 108 of the closure faceplate 102 from the pool side such that the sealing gasket 114 of the cover 104 engages the flange 103 of the closure faceplate 102 while the cover 104 is in the unlocked position, i.e., when the cam lock 134 is parallel to the plane of the cover plate 112. After insertion, the cam lock 134 is moved to a locking position by rotating the cam lock 134 such that it is perpendicular to the plane of cover plate 112. As the cam lock 134 is moved to the perpendicular, locking position, the cam lock 134 forces the spreader or wedge-shaped spreader plate 130 into engagement with the inside of the sealing gasket 114, thereby forcing the sealing gasket 114 into sealing engagement with the flange 103 of the closure faceplate 102 to prevent water leakage into the skimmer opening 101.

Figure 9:
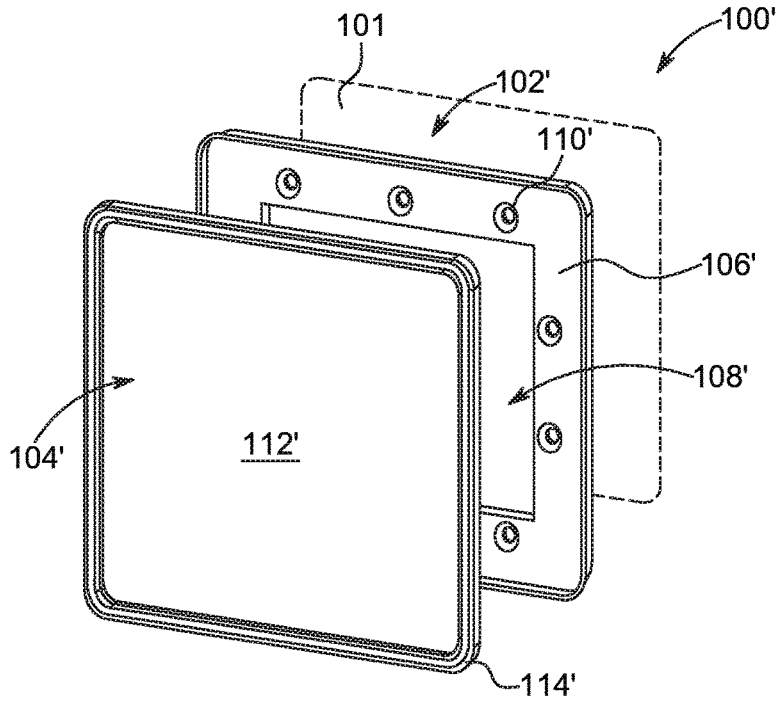
FIG. 9 is an exploded perspective view of a sealing closure of another preferred and non-limiting embodiment or aspect of the invention.
Figure 10:
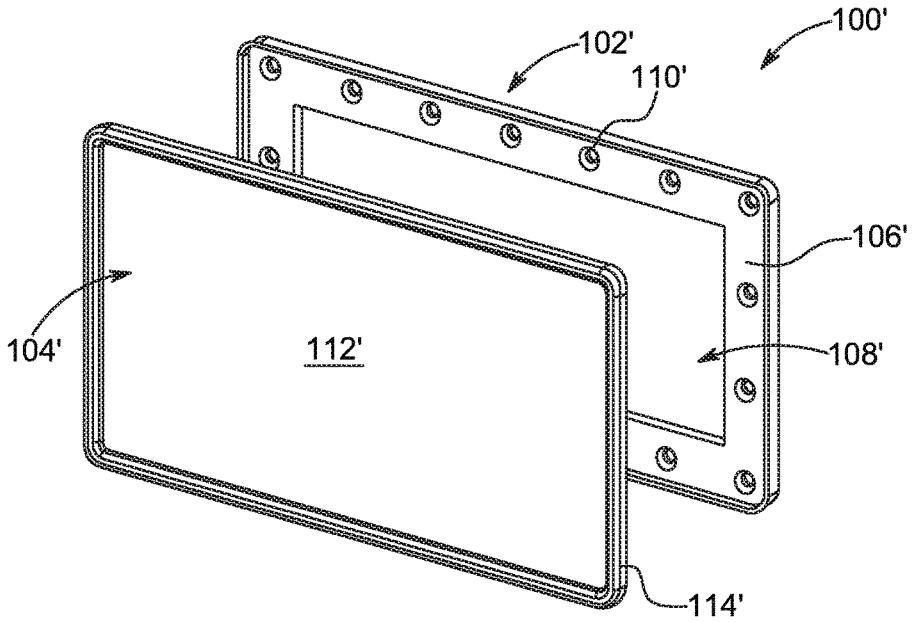
FIG. 10 is an exploded perspective view of a sealing closure of another preferred and non-limiting embodiment or aspect of the invention.

With reference to FIGS. 9-10, a sealing closure assembly 100' is shown in accordance with another preferred and non-limiting embodiment or aspect of the present disclosure. The sealing closure assembly 100' is configured for use with a skimmer (not shown) of a pool, spa, hot tub, or the like. The sealing closure assembly 100' is configured to close a skimmer opening 101 and prevent water from entering the skimmer opening 101.

With continued reference to FIGS. 9-10, the sealing closure assembly 100' includes a closure faceplate 102' and a cover 104' configured for removably connecting to the closure faceplate 102'. The closure faceplate 102' is configured to be connected to the skimmer opening 101, such as the skimmer peripheral flange (not shown), on the pool or water side of the skimmer. The closure faceplate 102' has a generally square (FIG. 9) or rectangular (FIG. 10) shape that corresponds to the outer shape of the skimmer peripheral flange. The closure faceplate 102' has a sidewall 106' defining an outer peripheral shape of the closure faceplate 102' and a central opening 108'. The closure faceplate 102' may have a flange 103' (FIG. 11) that extends around the inner periphery of the central opening 108' such that the flange 103' overlaps the skimmer peripheral flange in order to prevent movement of the closure faceplate 102' into the skimmer opening 101. The sidewall 106' of the closure faceplate 102' has one or more through-holes 110' configured to receive a fastener element (not shown), such as a screw, to connect the closure faceplate 102' to the skimmer peripheral flange. The closure faceplate 102' may have a lip 105' (shown in FIG. 11) extending around an outer periphery of the sidewall 106'. The lip 105' may be continuous or discontinuous around an outer periphery of the sidewall 106'. The lip 105' may be configured for engaging at least a portion of the cover 104', as described herein. In some aspects, the closure faceplate 102' is formed as a one-piece integral member formed from a rigid material. For example, the closure faceplate 102' may be injection molded from a hard plastic material, such as an ABS plastic resin that resists dimensional shrinking due to temperature variations.

Figure 11:
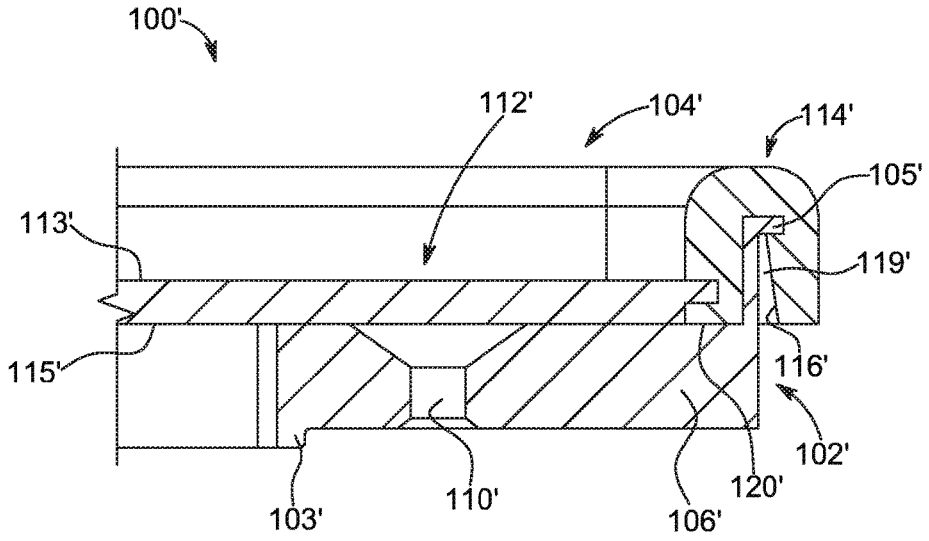
FIG. 11 is a detailed side cross-sectional view of the sealing closure shown in FIG. 9.

With continued reference to FIGS. 9-10, the cover 104' is configured to be removably secured to the closure faceplate 102'. Referring now to FIG. 11, the cover 104' has a cover plate 112' that is shaped to correspond to an outer shape of the closure faceplate 102'. The cover plate 112' has a top surface 113' opposite a bottom surface 115'. The cover plate 112' has one or more openings 117' (FIGS. 13-14) extending between the top surface 113' and the bottom surface 115' around an outer periphery of the cover plate 112'. The one or more openings 117' may have even or uneven spacing around the outer periphery of the cover plate 112'.

With continued reference to FIG. 11, a sealing gasket 114' is integrally formed about the outer periphery of the cover plate 112'. The cover plate 112', together with the sealing gasket 114', fits snugly around the sidewall 106' of the closure faceplate 102'. For example, the cover plate 112' may be configured to interface with the closure faceplate 102' such that the sealing gasket 114' surrounds or envelops a peripheral lip on the closure faceplate 102'. The monolithic sealing gasket 114' is preferably formed by injection molding from a resilient thermoplastic elastomer which remains flexible in varying temperature settings and is resistant to degradation over time.

Figure 12:
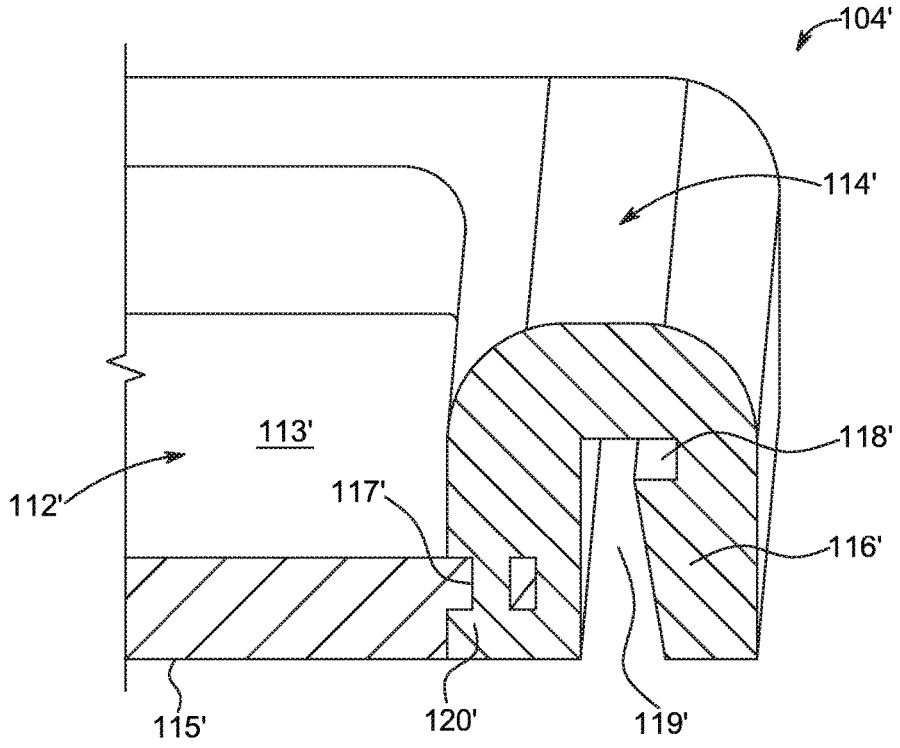
FIG. 12 is a detailed perspective cross-sectional view of the sealing closure shown in FIG. 9.

With reference to FIG. 12 and with continued reference to FIG. 11, the sealing gasket 114' has a peripheral recess 119' with a tapered entry area 116' that defines an opening for receiving the lip 105' of the closure plate 102' (shown in FIG. 11). The tapered entry area 116' tapers inwardly such that the opening narrows. At its narrowest point, the opening expands into an upper stop section 118' that is configured to receive the lip 105' of the closure faceplate 102'. In use, a portion of the tapered entry area 116' is deflected outward by the lip 105' as the cover 104' is engaged with the closure faceplate 102'. The tapered entry area 116' is deflected until the lip 105' of the closure faceplate 102' enters the upper stop section 118', at which point the deflected portion of the tapered entry area 116' is deflected to its initial position to completely encapsulate the lip 105'. When connected, the tapered entry area 116' of the sealing gasket 114' contacts the lip 105' and the sidewall 106' of the closure faceplate 102' such that no water can enter the sealing closure assembly 100' and the skimmer opening 101 from the poolside. Thus, no water can enter the skimmer body, pump pipe, pump, filtration equipment, or heater from the pool.

Figure 13:
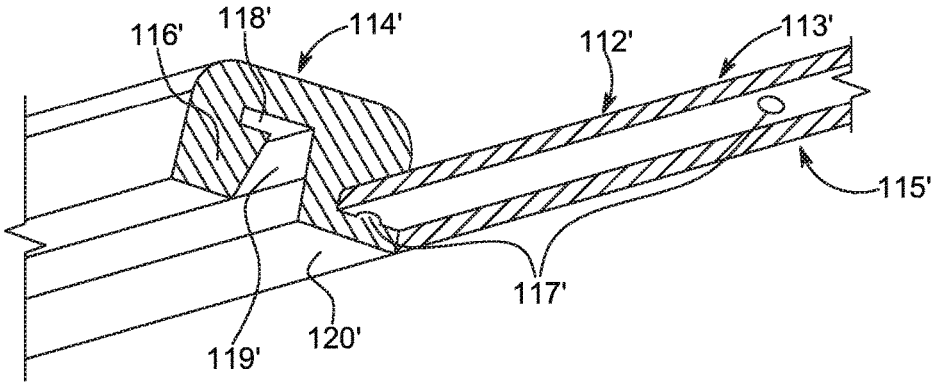
FIG. 13 is a detailed, bottom perspective cross-sectional view of a sealing closure of another preferred and non-limiting embodiment or aspect of the invention.
Figure 14:
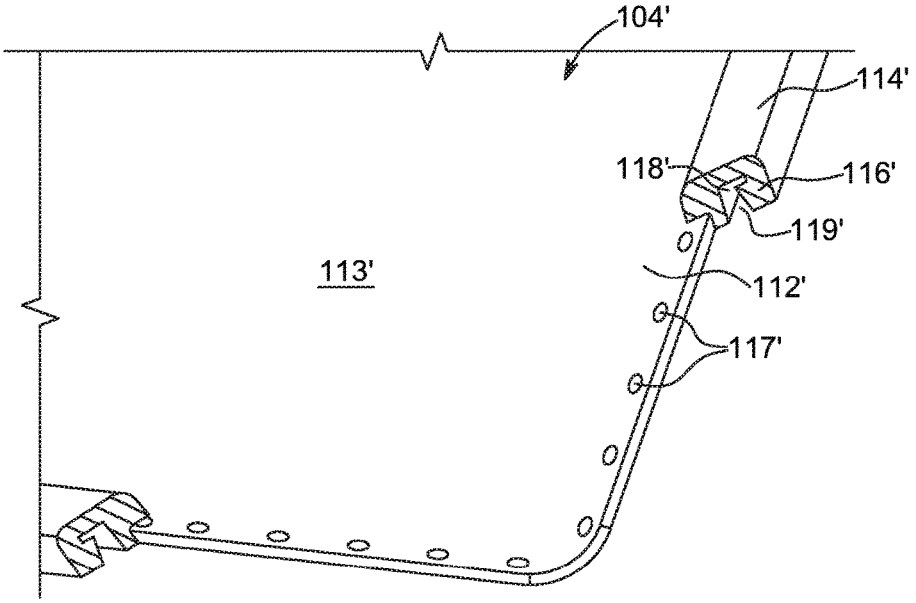
FIG. 14 is a detailed, top perspective cross-sectional view of the sealing closure shown in FIG. 13.

With continued reference to FIG. 12, and with reference to FIGS. 13-14, the one or more openings 117' on the cover plate 112' are configured to receive at least a portion of the sealing gasket 114'. For example, the sealing gasket 114' may extend through the entire opening 117'. In this manner, at least a portion of the sealing gasket 114' is embedded within at least one opening 117' on the cover plate 112'. In this manner, the material of the sealing gasket 114' completely encapsulates the opening 117' such that the sealing gasket 114' is monolithically formed with the cover plate 112'. The sealing gasket 114' thus may be inseparable from the cover plate 112'. In some aspects, the sealing gasket 114' may extend through each of the one or more openings 117' on the cover plate 112'. The sealing gasket 114' and the cover plate 112' may be joined monolithically using an overmolding technique. In some aspects, the sealing gasket 114' may have a lower extension 120' that extends along at least a portion of the bottom surface 115' of the cover plate 112'. When the cover 104' is installed on the closure faceplate 102', the lower extension 120' may contact at least a portion of the sidewall 106' to further seal the interface between the cover 104' and the closure faceplate 102'.

The cover 104' having the cover plate 112' and the sealing gasket 114' is formed such that the rigid cover plate 112' resists dimensional deformation due to temperature variations while the resilient sealing gasket 114' allows for slight movement. In this manner, the cover plate 112' may resist stretching or breaking due to contact with ice, while the resilient sealing gasket 114' maintains the seal with the closure faceplate 102' while allowing for movement due to contact with ice.

While specific embodiments or aspects of the invention have been described in detail, it will be appreciated by those skilled in the art that various modifications and alternatives to those details could be developed in light of the overall teachings of the disclosure. The presently preferred embodiments or aspects described herein are meant to be illustrative only and not limiting as to the scope of the invention which is to be given the full breadth of the appended claims and any and all equivalents thereof.

The invention claimed is:

1. A sealing closure assembly for closing a skimmer opening of a swimming pool skimmer, the sealing closure assembly comprising:

a closure faceplate having an integral sidewall with a central opening shaped to surround the skimmer opening;

a cover element configured for being removably connected to the closure faceplate, the cover element comprising:

a cover plate having a top surface opposite a bottom surface and a plurality of openings extending between the top surface and the bottom surface around an outer periphery of the cover plate; and a sealing gasket extending around the outer periphery of the cover plate, wherein at least a portion of the sealing gasket extends through at least one of the plurality of openings on the cover plate.

2. The sealing closure assembly of claim 1, wherein the sealing gasket has a peripheral recess for receiving a peripheral lip of the closure faceplate when the cover element is connected to the closure faceplate.

3. The sealing closure assembly of claim 1, wherein the closure faceplate has a peripheral lip extending around an outer periphery of the closure faceplate.

4. The sealing closure assembly of claim 1, wherein the closure faceplate has a flange that overlaps a peripheral area of the skimmer opening.

5. The sealing closure assembly of claim 1, wherein the closure faceplate is made from an ABS plastic resin.

6. The sealing closure assembly of claim 1, wherein the sealing gasket is made from a thermoplastic elastomer material.

7. The sealing closure assembly of claim 1, wherein the sealing gasket is molded over the cover plate.

8. The sealing closure assembly of claim 1, wherein the sealing gasket is monolithically formed with the cover plate.

9. A cover element for closing a skimmer opening of a swimming pool skimmer, the cover element comprising:

a cover plate having a top surface opposite a bottom surface and a plurality of openings extending between the top surface and the bottom surface around an outer periphery of the cover plate; and a sealing gasket monolithically formed around the outer periphery of the cover plate, wherein at least a portion of the sealing gasket extends through at least one of the plurality of openings on the cover plate.

10. The cover element of claim 9, wherein the sealing gasket has a peripheral recess for receiving a peripheral lip of a closure faceplate when the cover element is connected to the closure faceplate.

11. The cover element of claim 9, wherein the sealing gasket is monolithically formed with the cover plate.

* * * * *